US005599497A

United States Patent [19]

Cordea et al.

[11] Patent Number: 5,599,497

[45] Date of Patent: Feb. 4, 1997

[54] ALLOY STEEL ROLL CASTER SHELL

[75] Inventors: James N. Cordea, West Chester, Ohio; Harshad V. Sheth, Rancho Palos Verdes, Calif.

[73] Assignee: National-Oilwell, L.P., Houston, Tex.

[21] Appl. No.: 507,630

[22] Filed: Jul. 26, 1995

[51] Int. Cl.[6] ..... C22C 38/44; C22C 38/46

[52] U.S. Cl. ..... 420/109; 492/54; 428/681; 428/683

[58] Field of Search ..... 420/109; 492/54; 428/683, 681

[56] References Cited

U.S. PATENT DOCUMENTS 4,409,027 10/1983 Cordea et al. ..... 75/128 W
4,802,528 2/1989 Terrasse et al. ..... 164/428
5,265,332 11/1993 Hartz ..... 29/895.212
5,316,596 5/1994 Kataoka ..... 148/321

FOREIGN PATENT DOCUMENTS 58-37156 3/1983 Japan ..... 420/109

*Primary Examiner*—Deborah Yee

[57] ABSTRACT

An alloy steel having particular utility for roll caster shells used in the direct casting of molten aluminum to sheet, consisting essentially of, in weight %, 0.25–0.45% C, 1.75–3.75% Cr, 0.75–2.5% Mo, 0.35 to 0.8% V, 0.4–1% Mn, greater than 0.4–1% Ni, 0.02% max P, 0.02% max S, up to 0.35% Si and balance essentially Fe. Roll caster shells fabricated from the steel have excellent toughness and ductility at room temperature to enable a greater shrink-fit with the core. The shells also have good resistance to heat checking. The excellent properties are provided by a controlled amount of $Mo_2C$ and VC as well as limiting the amount of C in solution.

9 Claims, 4 Drawing Sheets

ALLOY STEEL ROLL CASTER SHELL

BACKGROUND OF THE INVENTION

The present invention relates to ferrous compositions which may be used for roll shells, a component of steel caster rolls which are used to strip cast aluminum alloys. The shells have excellent resistance to heat checking at higher shrink-fit stresses between the shells and the water cooled cores.

Molten aluminum at about 675° C. is directly cast to strip between two water cooled rolls each composed of a roll shell (hoop or sleeve) which has been shrink-fitted on a water cooled core. The rolls arc driven rotationally in opposite directions and the distance between them determines the thickness of the cast strip. The cast strip solidifies in contact with the rolls. The main function of the shells is to contain and extract heat from the molten aluminum to control the solidification and provide a good aluminum cast surface.

The shells must have excellent mechanical properties such as high strength and toughness since the rolls arc subjected to stresses caused by separating forces and roll drive forces during casting. The shells will also have to withstand the mechanical stress due to the shrink-fit between the shells and the water cooled cores. Additionally, the shell surfaces will continuously expand and contract during the cyclic temperatures developed during casting. This cyclic stress developed on the surfaces will contribute to the initiation and propagation of any cracks or defects formed during casting. Therefore, the rolls must also possess good resistance to thermal fatigue.

Thermal fatigue is caused by any variation in temperature which generates a change in dimension. If a material is heated homogeneously, the uniform temperature change will bring a change in volume but no stress. However, a temperature gradient in the material causes stress to occur in relation to the thermal gradient. When the shell surface contacts the molten aluminum, the surface temperature rapidly increases while the bulk of the shell is cooled by thermal transfer from the water cooled core. The stress levels reached will exceed the compressive yield strength of the steel and result in plastic deformation of the shell surface while in contact with the molten aluminum. When that portion of the shell moves away from the molten aluminum, it rapidly decreases in temperature and will contract causing high surface tensile stresses. Numerous cycles of this type will eventually cause mechanical fatigue and cracking when the ductility is exhausted. After a number of hours of casting, the surfaces of any roll shells will develop heat checking patterns or surface cracks which grow deeper into the shells and eventually mark the cast strip. These defects may also cause complete failure of the roll shells if allowed to grow excessively large. Periodic reconditioning of the shells is to be expected. Typically, reconditioning will remove up to about 0.15 inches (3.8 mm) of the shell thickness.

Resistance to heat checking and cracking is generally associated with a low coefficient of thermal expansion, high thermal conductivity, high elevated temperature yield strength, high elevated temperature ductility and a low modulus of elasticity. This combination of properties is difficult to attain and attempts to improve one of these properties has usually resulted in a sacrifice in one or more of the other properties.

The shells must also have good mechanical properties at room temperature because of the many stresses introduced during machining and reconditioning. Good ductility and toughness are very important to avoid brittleness during grinding and handling which could cause further cracking.

U.S. Pat. No. 4,409,027 (assigned to Armco Inc.) used a ferritic alloy composition for the roll shell which consisted essentially of, in weight %, about 0.53 to about 0.58% C, about 0.4 to about 1% Mn, 0.1 to 0.2% Si, about 0.02% max P, about 0.02% max S, about 0.45 to about 0.55% Ni, 1.5 to 3.0% Cr, 0.8 to 1.2% Mo, 0.3 to 0.5% V and balance essentially iron.

Stresses which are greater than the yield strength and tensile in nature will produce heat checks or cracks by a thermal fatigue mechanism when cyclic yielding or plastic flow occurs. A hysteresis loop can be plotted representing the accumulation of plastic damage during each cycle for the circumferential stresses perpendicular to the longitudinal cracks in the roll shell surface. In prior an chromium-molybdenum steels, the number of cycles to failure is about $10^4$ if the extent of plastic deformation per cycle is about 0.001 inch per inch or slightly less. High carbon levels were required to provide hardness, strength and resistance to localized softening which resulted from the distribution of carbon in the microstructure. Molybdenum and vanadium were increased to form carbides which increased the elevated temperature strength. By increasing the elevated temperature yield strength by 50–100%, the service life was increased three-fold if the elevated temperature ductility was maintained. This patent found that increasing the elevated temperature yield strength more than compensated for the loss in thermal expansion, modulus of elasticity and conductivity when improving the resistance to checking.

In the equation set forth in U.S. Pat. No. 4,409,027 for total thermal strain [thermal strain ($\epsilon_t$)=$\alpha\Delta T$ where $\alpha$ is the coefficient of thermal expansion and $\Delta T$ is 1150° F. which represents the difference between the maximum roll surface at 1250° F. and the minimum roll surface temperature of 100° F.], the total strain is assumed to be the sum of elastic and plastic components:

$$\epsilon_t=\epsilon_{elastic}+\epsilon_{plastic}=\sigma y/E+\epsilon_{plastic}$$

where $\sigma y$ is the yield strength in tension and E is the elastic modulus

Thus, the elastic component of the strain is represented by the yield strength in tension divided by the elastic modulus. In the case of a steel having a yield strength of 200,000 psi at room temperature, $\epsilon_{elastic}=\epsilon y/E=200{,}000/30.8\times10^6$ psi–$6.49\times10^{-3}$ in/in. If the yield strength is decreased by 50% at elevated temperatures, such as 1250° F., the $\epsilon_{elastic}=\epsilon y/E=100{,}000/24\times10^6$ psi$=4.16\times10^{-3}$ in/in.

Where the total strain is equal to or greater than twice the elastic strain, to account for the compression and tension portion of elastic reaction, then plastic flow is possible in both the compression and tension ends of the cycle. With a 50% decrease in yield strength to 100,000 psi, $2\times\epsilon_{elastic}=2\times4.16\times10^{-3}=8.32\times10^{-3}$ in/in. The plastic component then becomes $\epsilon_{plastic}=\epsilon_t-2\times\epsilon_{elastic}=8.0\times10^{-4}$ in/in.

Consequently, a plastic flow of about 0.001 inch per inch per cycle is possible, which would indicate a potential exhaustion of plasticity and failure in $10^4$ to $10^5$ cycles.

The calculations are believed to support the belief that the high elevated temperature yield strength of the steel causes a much greater percentage of the thermal expansion and contraction to occur in the elastic region. This minimizes the plastic reaction and results in much greater resistance to heat checking. Maintenance of the high ductility of the steel at a higher yield strength insures a retarded crack growth rate once heat checking does occur.

While the roll shell of this patent had good elevated temperature strength, the material did not have good toughness and ductility at room temperature which is required for a higher shrink-fit to minimize slippage between the shell and core. Improving the toughness would also allow the material to withstand the handling required during grinding to remove heat checks and resist the propagation of cracks.

A standard alloy used for roll caster shells referenced in U.S. Pat. No. 4,409,027 comprised 0.53–0.58% C, 0.45–0.65% Mn, 0.2–0.3% Si, 0.4–0.5% Ni, 1–1.2% Cr, 0.45–0.55% Mo, 0.1–0.15% V, 0.02% max P, 0.02% max S and balance essentially Fe.

Another alloy referenced in U.S. Pat. No. 4,409,027 as an Al die casting alloy had 0.3–0.4% C., 0.2–0.4% Mn, 0.8–1.2% Si, 4.75–5.5% Cr, 1.25–1.75% Mo, 0.8–1.2% V and balance Fe. It was discussed as being expensive and difficult ti process.

U.S. Pat. No. 4,802,528 (assigned to Chavanne-Ketin) produced forged casings for continuous casting aluminum from an alloy steel having 0.3–0.36% C, 0.3–0.6% Mn, 0.15–0.45% Si, less than 0.4% Ni, 2.8–3.4% Cr, 0.85–1.25% Mo, 0.1–0.3% V, 0.02max P, 0.02% max S, 0.3% max Cu, and balance essentially Fe. This alloy reduced the carbon content from previous alloys to improve ductility and toughness. While sacrificing some thermal conductivity, the grade of steel is stated to have a surprising improvement in resistance to thermal fatigue cracking. This patent studied the mechanical and thermal cycles of the roll during shrink-fitting and casting of aluminum. The roll shell has mechanical stress related to roll production which produces circumferential tensile stress and longitudinal stress and it has operating stress from torsion due to the driving torque and bending stress due to separating forces during casting. The thermal stresses relate to the difference in temperature between the inner cooled core of the roll and the temperature of the molten aluminum which cause the roll shell to exceed the elastic limit of the steel which causes plastic deformation. The cooling of the roll causes the deformation to start to disappear but the shell can not return to its original position because of the plastic deformation in compression. The return to the low temperature will cause the elastic limit to be exceeded in tension and result in plastic deformation. This cycle of deformation of thermal origin will cause fatigue of the surface and result in the initiation and subsequent propagation of microcracks. One of the essential properties demanded of the roll shell is the resistance to thermal fatigue.

An alloy referenced in U.S. Pat. No. 4,802,528 used for roll caster shells had 0.53–0.57% C, 0.9–1.3% Cr, 0.4–0.6% Mo, 0.1–0.2% V, 0.7–0.9% Mn, 0.4–0.7% Ni and 0.2–0.4% Si, 0.02% max P, 0.02% max S and balance essentially Fe.

Another alloy referenced in U.S. Pat. No. 4,802,528 used for roll caster shells had 0.53–0.58% C, 1.5–3% Cr, 0.8–1.2% Mo, 0.3–0.5% V, 0.4–1.0% Mn, 0.45–0.55% and 0.1–0.2% Si, 0.02% max P, 0.02% max S and balance essentially Fe.

U.S. Pat. No. 4,861,549 (assigned to National Forge Company) disclosed a ferritic steel preferably containing 0.45–0.49% C, 1.20–1.50% Ni, 0.90–1.00% Mn, 1.20–1.45% Cr, 0.010% max P, 0.80–1.00% Mo, 0.002% max S, 0.15–0.20% V, 0.15–0.35% Si, up to 0.08% rare earth metals and balance Fe. The steel was designed for roll shells to cast aluminum sheets. The steel was stated to have good resistance to heat checking and cracking when subjected to extreme heat stresses in repeated thermal cycles. Rare earth elements were added to avoid temper embrittlement.

Prior attempts to provide good elevated temperature yield strength for reducing heat checking and craze cracking have also increased the room temperature yield strength. This has an adverse effect on the ductility and shrink-fit process. High carbon was used to provide solution strengthening for elevated temperature strength but this made the steel brittle at room temperature and had an adverse effect on toughness.

Even though some improvements in service life were obtained for the rolls used to strip cast aluminum alloys, there is still a need for further improvement in order to increase production and improve the quality of the aluminum strip. There is also a need to increase the shrink-fit between the shell and the core of the roll without adding excessively to stresses in the shell. This allows for less slippage of the shell over the core during casting. Prior roll shell alloys had chemistries balanced to provide good high temperature properties and were less concerned with room temperature properties which are critical for shrink-fit and machining properties.

SUMMARY OF THE INVENTION

A ferritic steel alloy having particular utility for roll caster shells used in the direct casting of molten aluminum to sheet, consists essentially of, in weight %, 0.25–0.45% C, 1.75–3.75% Cr, 0.75–2.5% Mo, 0.35 to about 0.75% V, 0.3–1% Mn, greater than 0.4 to about 1% Ni, 0.02% max P, 0.02% max S, up to 0.35% Si and balance essentially Fe. Caster shells fabricated from the present steel have excellent toughness and ductility at room temperature which enable a greater shrink-fit with the core. The shells also have excellent elevated temperature yield strength and resistance to heat checking. The steel of the present invention has a unique combination of properties which make the steel particularly well suited for the application of roll caster shells which are forged, heat treated and shrunk onto a core.

The steel alloy is characterized by the control of carbon in solution and the carbon combined with molybdenum and vanadium as carbides. By controlling the level of carbon in solution and the amount of carbides, there is better combination of yield strength at elevated temperature and at room temperature. The present steel alloys minimize the yield strength at room temperature and maximize the yield strength at elevated temperature. This provides an improved combination of properties for resisting heat checking at elevated temperature and improving ductility and toughness at room temperature. By having a higher percentage of carbon tied up as $Mo_2C$ and VC, the range of elasticity is increased and this provides good resistance to embrittlement and excellent toughness. The total amount of carbon present in the alloy is considerably reduced over most prior roll shell alloys (typically 0.3 vs. 0.55%). The steels with lower carbon contents are much less susceptible to quench cracking during heat treatment.

An object of the present invention is to provide a roll shell composition which has excellent shrink-fit to the core for rolls used for continuous casting aluminum.

An additional object of the present invention is the production of roll shells having excellent resistance to heat checking and cracking during service.

A still further object of the present invention is to provide a roll shell which has a combination of excellent toughness and resistance to embrittlement at room temperature and high yield strength at elevated temperatures.

A feature of the present invention is the use of lower carbon in solid solution with higher amounts of molybdenum and vanadium to maintain a combination of excellent toughness at low temperatures and thermal fatigue resistance at elevated temperatures.

An additional feature of the present invention is the use of higher levels of vanadium and molybdenum to form carbides which increases the yield strength at elevated temperatures.

A still additional feature of the present invention is the use of low carbon in solution to provide good ductility.

Another feature of the present invention is the use of higher contents of Mo, Ni and Mn to provide good hardenability for a refined heat treated microstructure.

It is an advantage of the present invention that the steels have excellent toughness and resistance to heat checking and cracking at elevated temperatures.

It is an additional advantage of the present invention that the formation of vanadium carbides, which are small, will reduce the possibility of cracking during service.

It is a still further advantage of the present invention that the production costs will be reduced because of increased roll service life and reduced surface defects on the aluminum strip.

It is also an advantage that the steels of the present invention with lower carbon contents are much less susceptible to quench cracking during heat treatment and may be quenched at a faster rate.

The above objects, features and advantages and others will become apparent upon consideration of the detailed description.

DESCRIPTION OF THE PREFERRED EMBODIMENTS

Figure 1:
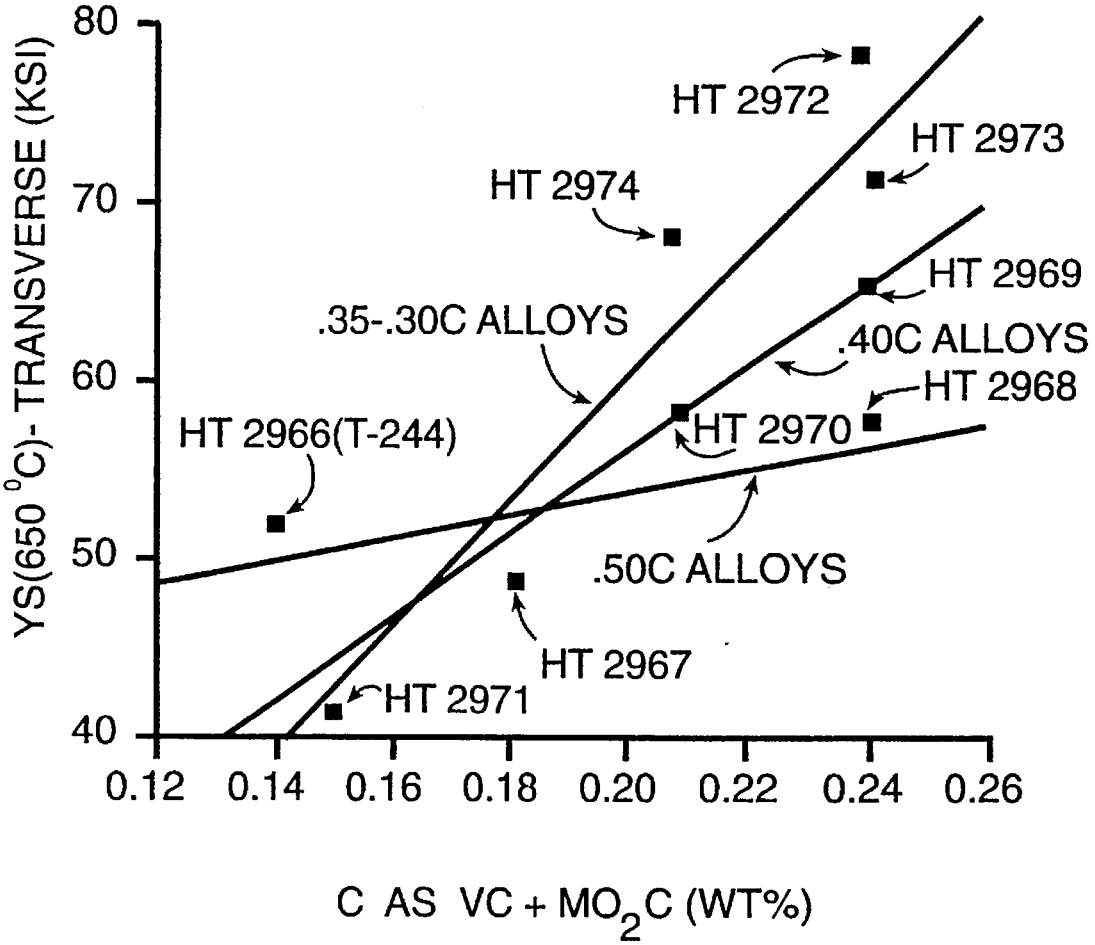
FIG. 1 is a graphic illustration of the relationship between the transverse yield strength at 650° C. and the amount of carbon which is combined with vanadium or molybdenum for three ranges of carbon.

The present invention provides a steel having a combination of room temperature and elevated temperature properties which have not been provided previously. The prior high carbon alloys used for roll shells in the aluminum casting industry had high room temperature strength but the ductility and toughness were low. The high carbon shell alloys were not designed for high shrink-fit with the core to reduce slippage or to provide good handling at room temperature to reduce breakage. In the past, increasing the strength and hardness to resist thermal fatigue at high temperatures to reduce checking has always been more important than controlling impact toughness and ductility at room temperature.

In order to improve the combination of properties for a roll shell, a new steel composition was developed which consists essentially of, in weight %, 0.25–0.45% C, 1.75–3.75% Cr, 0.75–2.5% Mo, 0.35 to about 0.75% V, greater than 0.4–1% Ni, 0.3–1% Mn, 0.02% max P, 0.02% max S, up to 0.35% Si and balance essentially Fe. Preferably the roll shell composition consists essentially of 0.25–0.35% C, 2.5–3.5% Cr, 1.3–1.8% Mo, 0.45–0.7% V, 0.4–0.6% Mn, 0.45–0.65% Ni, up to 0.25% Si and balance essentially Fe. More preferably, the steel will consist essentially of about 2.8–3.2% Cr, about 1.4–1.6% Mo, about 0.5–0.6% V, about 0.45–0.55% Mn and about 0.45–0.6% Ni, up to 0.2% silicon and balance essentially Fe. The aim composition consists essentially of about 0.3% C, about 3% Cr, about 1.5% Mo, about 0.5% V, about 0.5% Mn, about 0.5% Ni, about 0.15% Si and balance essentially iron.

Carbon is added to the present steel in an amount of 0.25 to 0.45% and preferably 0.25 to 0.35% with an aim of about 0.3%. Carbon provides hardness and strength to the structure, thermal fatigue resistance at elevated temperatures and control of the phase change when processing near the $A_3$ critical temperature. The present invention provides excellent properties at a lower carbon level than is normally used. The use of lower carbon provides good ductility and impact resistance at room temperature. The steel will also have lower levels of carbon in solution because of the vanadium and molybdenum additions. The lower carbon levels of the present invention also permit water cooling in service without cracking which increases its service life. The distribution of the carbon within the microstructure is controlled to provide adequate strength and resist localized softening. A lower carbon level represents a major change from the prior an which believed that at least 0.5% carbon was required in order to provide the desired hardness and strength for thermal fatigue resistance at elevated temperatures. U.S. Pat. No. 4,802,528 is the only use of lower carbon in roll shells known and this teaching lacks the proper amount of molybdenum and vanadium required for producing the desired combination of properties at room temperature and elevated temperatures. This patent also includes a very low amount of nickel. One must look at the amount of carbon combined as a precipitate of molybdenum or vanadium and the amount of carbon in solution to resist checking at elevated temperature and also provide good ductility and toughness at room temperature to facilitate the securing of the roll shell to the core by shrink-fitting. Typically at least about two-thirds of the carbon will be in the form of a carbide in the present invention.

Chromium is present in the steels of the present invention in an amount of 1.75 to 3.75% and preferably from 2.5 to 3.5% and more preferably from about 2.8 to 3.2%. About 3% chromium is the typical aim. In the past, chromium was typically below 3% to avoid a loss in ductility and to lower the cost of the raw materials. Chromium in the range of the present invention provides good resistance to heat softening in combination with the addition of carbide forming elements vanadium and molybdenum. Chromium also increases the strength and oxidation resistance at elevated temperatures. Chromium also stabilizes the ferrite to higher temperatures by raising the eutectoid temperature. Chromium carbides will increase the elevated temperature strength.

Molybdenum is added in an amount of 0.75 to 2.5%, preferably from 1.3 to 1.8% and more preferably about 1.4 to 1.6%. A typical aim is about 1.5% molybdenum. Molybdenum is a strong carbide forming element and serves to increase the elevated temperature strength. Molybdenum was restricted in many other alloys for roll shells because of a decrease in toughness. The present alloy balance allows higher molybdenum levels while still maintaining good notch toughness. Molybdenum raises the eutectoid temperature and counteracts temper embrittlement during heat treatment. Molybdenum increases the resistance to craze cracking.

Vanadium is added in an amount of 0.35 to 0.8% and typically from 0.35 to about 0.75%. Vanadium is preferably added in an amount of 0.45 to 0.7% and more preferably in an amount from about 0.5 to 0.6%. A typical aim is about 0.5% vanadium. Vanadium allows the development of refined heat treated structures in thicker sections. Vanadium carbide provides good wear resistance of the roll shell and increases the elevated temperature strength. Prior workers limited the amounts of vanadium to less than 0.35% in an attempt to not degrade the impact toughness. The carbides are small and reduce the possibility of cracking during service. It is desired to provide a uniform distribution of carbides across the shell to provide uniform properties. Vanadium and molybdenum combine with the carbon to form carbides and restrict the amount of carbon in solution.

Manganese is present in an amount from 0.3% to 1% and typically from 0.3% to 0.75%. Manganese is preferably present from 0.4% to 0.6% and more preferably from about 0.45 to 0.55%. A typical aim is about 0.5% manganese. Manganese increases the hardness and combines with the sulfur present in the alloy. Manganese will aid in the deoxidization of the alloy. Levels above 1% will tend to increase the heat checking because manganese will stabilize the austenite after heat treatment and quenching.

Nickel is present in an amount greater than 0.4 to 1% and typically in an amount of 0.45 to 0.75%. Nickel is preferably added in an amount of 0.45 to 0.65% and more preferably, in an amount of about 0.45 to 0.6%. A typical aim is about 0.5% nickel. Nickel increases the toughness of the steel. Amounts greater than 0.75% tend to retain the austenite after quenching and also increase the cost of the steel. Nickel promotes good toughness and tends to balance the negative influences of chromium, molybdenum and vanadium on toughness.

Phosphorus and sulfur are normally present as residual elements and each should be restricted to amounts less than 0.02% in order to avoid embrittlement and heat checking.

Other carbide forming elements, such as tungsten, niobium and titanium, could be added as partial substitutions for the molybdenum and/or vanadium. If added, these elements should be limited to an amount less than about 0.2% each. Excessive amounts of these elements contribute adversely to the ductility and toughness of the steel.

Silicon is present in amounts less than 0.35% and is used primarily as a deoxidizer. Although silicon provides a small increase in strength, it is preferably added in amounts less than 0.25% and more preferably in amounts less than 0.2%.

The property data in the tables and figures was based on the transverse direction because this represents the most conservative, lowest value, especially for ductility and toughness. Transverse properties are less favorable then longitudinal properties.

FIG. 1 illustrates the variation in yield strength at 650° C., which is near the aluminum casting temperature, with the amount of carbon tied up as molybdenum or vanadium carbide. The data is taken from the heats processed in TABLE 1 when grouped by 1) 0.3–0.35% C; 2) 0.4% C; and 3) 0.5% C. The amount of carbon which is combined with molybdenum or vanadium as a carbide is controlled to provide good elevated temperature yield strength. A higher elevated yield strength is related to increased resistance to heat checking. The amount of carbon combined as $Mo_2C$ or VC is easily determined on a molecular weight basis. For example, Heat 2967 with 0.5%V and 1%Mo would have 0.18% carbon combined as a carbide [12/51(0.5%)=0.12% as VC+12/192(1%)=0.06% as $Mo_2C$]. The yield strength data for FIG. 1 is found in TABLE 2. Heat 2966 (current T-244 composition widely used and described in U.S. Pat. No. 4,409,027) represents a typical yield strength level for prior roll shell alloys. As carbon tied up as $Mo_2C$ and VC increased, the elevated temperature yield strength also increased at all carbon levels.

The most dramatic increase shown in FIG. 1 is at the lower carbon contents (0.3–0.35%). These results indicate why the carbon is maintained below 0.5% and preferably below 0.4%. With a large amount of carbon, such as 0.5%, there is not nearly as dramatic increase in strength when Mo and V carbides are present (for example see Heat 2966). When greater than half of the carbon is present as a carbide of Mo or V, the increases in yield strength are the greatest. Preferably at least two-thirds of the carbon, when present in the ranges of the present invention, should be combined with Mo or V to obtain the greatest benefit in elevated temperature yield strength. Heat 2974 is an example which illustrates the benefit of maintaining this relationship. Without wishing to be bound by theory, the strengthening mechanism appears to be more effective when the vanadium and molybdenum carbides are combined with a greater percentage of the total carbon. Prior alloys which relied upon 0.5–0.6% carbon obtained good hardness and strength at elevated temperatures and provided good thermal fatigue resistance but had low ductility and toughness at room temperature. These steel alloy shells when experiencing high core to shell shrink-fit conditions were very susceptible to brittle failure at room temperature.

Figure 2:
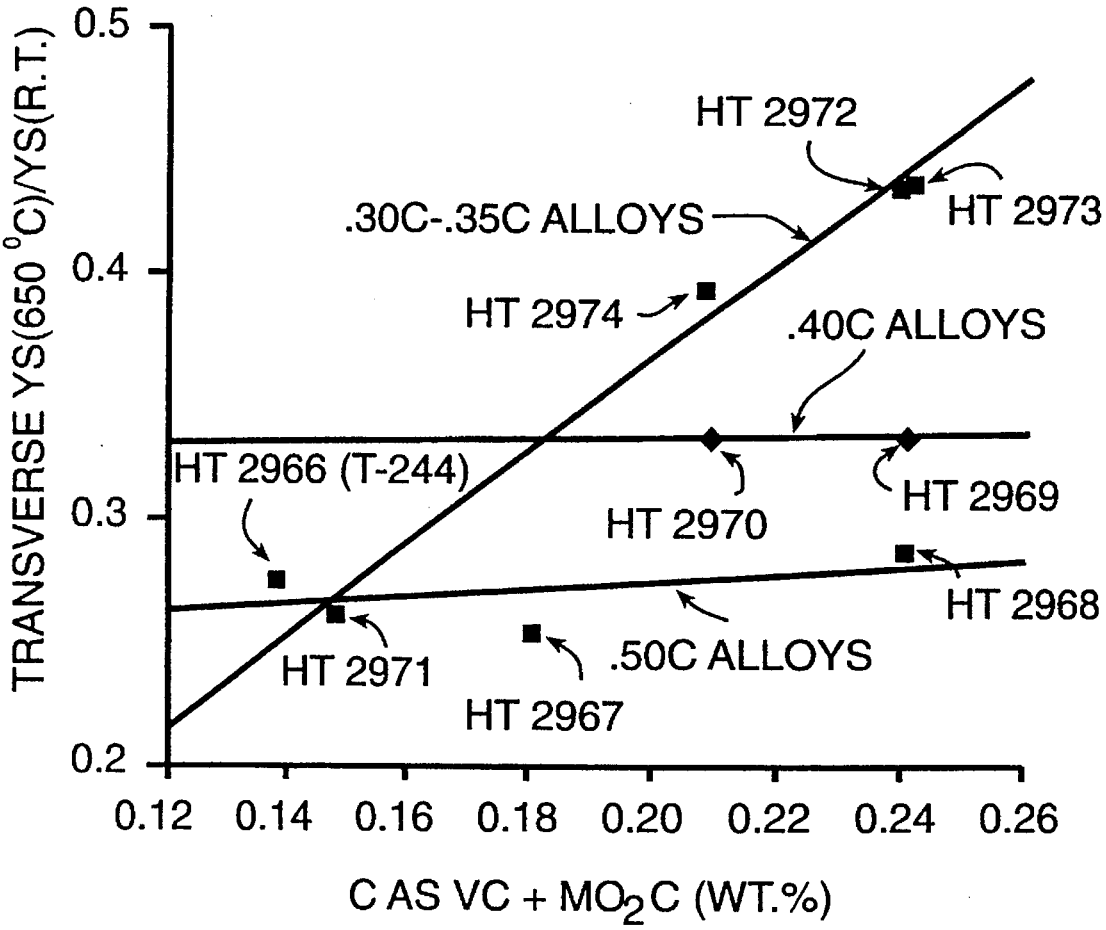
FIG. 2 is a graphic illustration of the relationship between the ratio of transverse yield strength at 650° C. divided by the transverse yield strength at room temperature and the amount of carbon which is combined with vanadium or molybdenum for three ranges of carbon.

FIG. 2 illustrates the increase in the ratio between the yield strength at 650° C. and the yield strength at room temperature as the amount of vanadium and molybdenum carbides increase. The data is taken from the heats processed in TABLE 1 when grouped by 1 ) 0.3–0.35% C; 2) 0.4% C; and 3) 0.5% C and the mechanical property data in TABLES 2 and 3. The most dramatic increase in yield strength ratio occurred for the 0.30–0.35 % C steel alloys. While the amount of vanadium and molybdenum carbides increase the elevated temperature yield strength (FIG. 1 ), it is also recognized that the room temperature yield strength may decrease especially for the lower carbon levels. This would have a great effect on the yield strength ratio and represents a major departure from previous alloys (note T244, Heat 2966) where one had to develop a high yield strength at room temperature in order to maintain a relatively high yield strength at elevated temperatures which is needed for resistance to heat checking. Prior attempts could not reduce the room temperature yield strength without decreasing the elevated yield strength. Low room temperature yield strength is helpful in tolerating a greater shrink-fit and allowing the roll shell to be machined without increasing the chances for crack propagation. The amount of carbon which is combined with molybdenum or vanadium is carefully controlled in the steels of the present invention.

Figure 3:
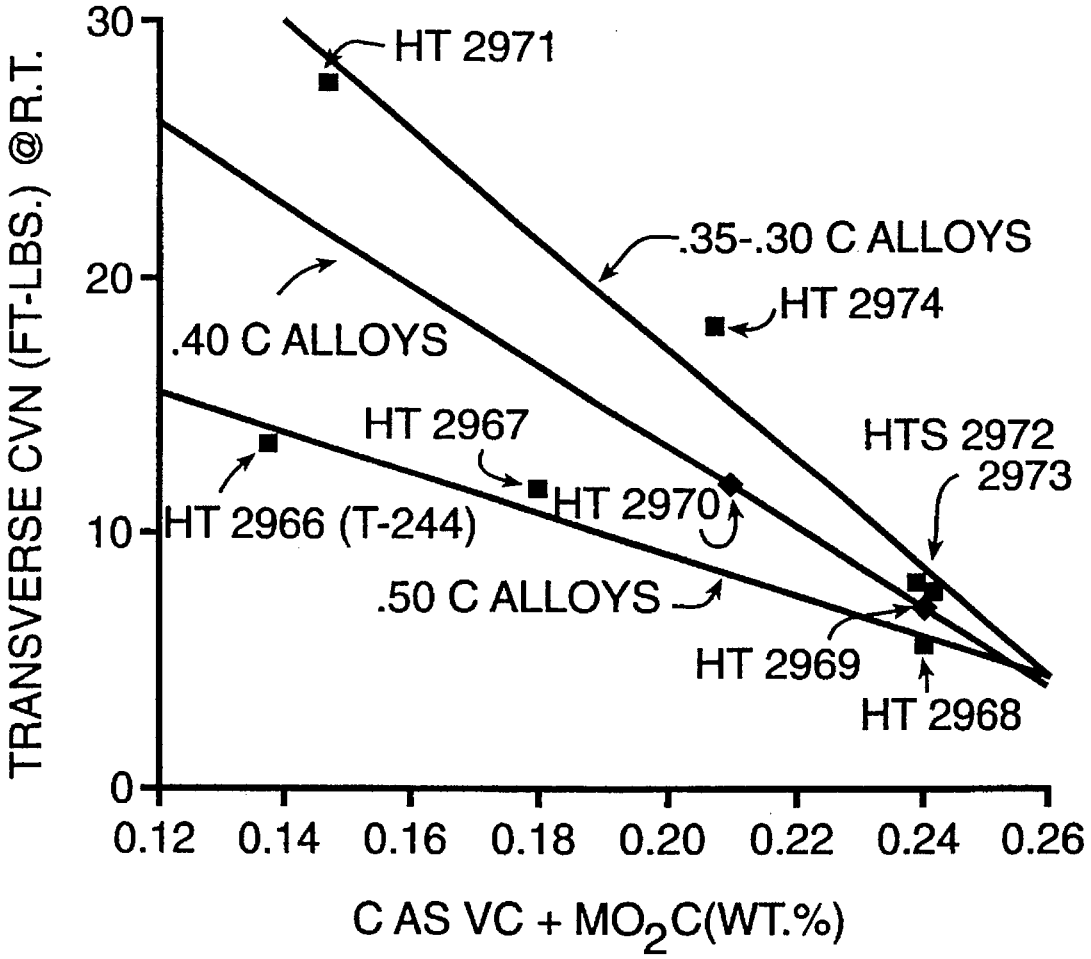
FIG. 3 is a graphic illustration of the relationship between the transverse impact toughness at room temperature and the amount of carbon which is combined with vanadium or molybdenum for three ranges of carbon.

FIG. 3 illustrates the improvement in impact toughness at room temperature in the transverse direction when the amount of carbon which is combined with molybdenum or vanadium is controlled. The data is taken from the heats processed in TABLE 1 when grouped by 1) 0.3–0.35% C; 2) 0.4% C; and 3) 0.5% C and the impact toughness data from TABLE 4. FIG. 3 shows the decrease in impact toughness as the carbon is combined with Mo and V. The greater toughness is shown at the lowest total carbon content and illustrates the importance of optimizing the amount of alloy carbides to provide maximum toughness and elevated temperature yield strength as shown in FIGS. 1 and 2.

Figure 4:
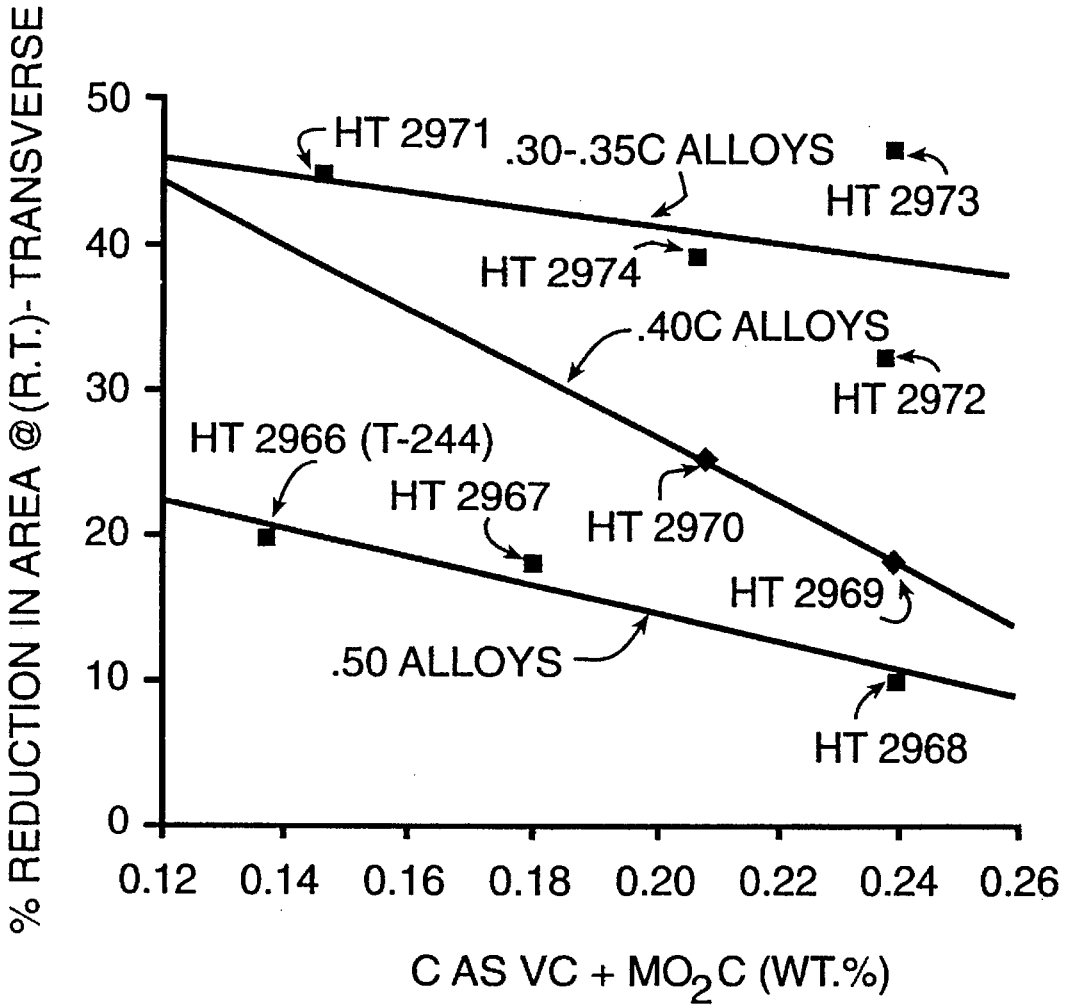
FIG. 4 is a graphic illustration of the relationship between the transverse reduction-in-area at room temperature and the amount of carbon which is combined with vanadium or molybdenum for three ranges of carbon.

FIG. 4 illustrates the improvement in tensile ductility at room temperature in the transverse direction when the amount of carbon which is combined with molybdenum or vanadium is controlled. Ductility is measured by the % reduction-in-area in TABLE 3. The data is taken from the heats processed in TABLE 1 when grouped by 1 ) 0.3–0.35% C; 2) 0.4% C; and 3) 0.5% C. The results illustrate that the optimum combination of properties is only obtained with the lower levels of total carbon content in combination with the critical amounts of $Mo_2C$ and VC if one is to provide an alloy with good ductility at room temperature and also good elevated temperature yield strength. With the 0.3–0.35% C steels, the ductility is the highest level and has the least deterioration when the addition of Mo and V is made and illustrates the importance of controlling the amount of $Mo_2C$ and VC to provide maximum ductility at the highest levels of elevated temperature yield strength.

TABLE 1

| | CHEMISTRY | | | | | | |
|---|---|---|---|---|---|---|---|
| Heat | % C | % Mn | % Cr | % Ni | % Mo | % V | % Fe |
| V2966# | 0.51 | 0.51 | 2.02 | 0.50 | 1.01 | 0.32 | Balance |
| V2967# | 0.51 | 0.51 | 2.01 | 0.50 | 1.00 | 0.50 | Balance |
| V2968# | 0.50 | 0.51 | 2.01 | 0.50 | 1.99 | 0.49 | Balance |
| V2969* | 0.42 | 0.51 | 2.01 | 0.50 | 1.99 | 0.49 | Balance |
| V2970* | 0.41 | 0.52 | 3.01 | 0.50 | 1.49 | 0.49 | Balance |
| V2971 | 0.35 | 0.51 | 3.02 | 0.50 | 0.49 | 0.50 | Balance |
| V2972* | 0.30 | 0.51 | 2.01 | 0.50 | 1.98 | 0.49 | Balance |
| V2973* | 0.31 | 0.52 | 2.01 | 0.50 | 0.99 | 0.76 | Balance |
| V2974* | 0.30 | 0.52 | 3.02 | 0.50 | 1.48 | 0.49 | Balance |

*steels of the invention
#steels of U.S. Pat. No. 4,409,027; T244 = V2966

All heats contained about 0.16% Si, about 0,003% P, about 0.003% S, about 0.002% N, about 0.02% Al and about 0.036% Cu All of the alloys in TABLE 1 were melted and processed in the laboratory to simulate commercial practice. Caster shell alloys are typically melted in an electric furnace, ladle degassed and cast into ingots which are soaked at temperatures of about 1225° C. The material is pierced, opened on a smaller mandrel and finish forged and drawn on a sized mandrel to cylinders 450 mm to 1000 mm in diameter. They are subsequently austenitized at 870° C. and rapidly quenched and double tempered to the desired mechanical properties.

Steels V2966-V2968 were not steels of the invention because of the high carbon contents. Steel V297 1 did not have the minimum amount of molybdenum. Steel 2973 has vanadium very near to the upper limit.

TABLE 2

ROLL SHELL MECHANICAL PROPERTIES - ELEVATED TEMPERATURE - 650° C.

| HEAT | Y.S. ksi T | T.S. ksi T | Elong % T | R.A. % T |
|---|---|---|---|---|
| V2966 | 52 | 83.5 | 44.5 | 92 |
| V2967 | 48.5 | 82.5 | 42 | 90 |
| V2968 | 57.5 | 89 | 42.5 | 82 |
| V2969* | 65 | 92.5 | 33.5 | 77 |
| V2970* | 58 | 85 | 35 | 84 |
| V2971 | 41.5 | 65.5 | 44.5 | 92 |
| V2972* | 78 | 102 | 21.5 | 71 |
| V2973* | 71 | 94.5 | 23 | 75 |
| V2974* | 68 | 91.5 | 24 | 81 |

*steels of the invention

The steels of the invention have excellent yield strength and tensile strength as calculated in U.S. Pat. No. 4,409,027 at elevated temperatures near the aluminum casting temperature as shown in TABLE 2. This is attributed to the formation of the carbides with molybdenum and vanadium. There is less carbon in solution and more precipitates. The elongation and reduction in area are not as good for the steels of the invention at elevated temperatures but represent an excellent combination of elevated temperature strength and ductility.

TABLE 3

ROLL SHELL MECHANICAL PROPERTIES - ROOM TEMPERATURE

| | Y.S.(RT) ksi L/T | T.S. ksi L/T | Elong. % L/T | R.A. % L/T | HB | HRC |
|---|---|---|---|---|---|---|
| V2966 | 190.5/188.5 | 232.5/231.5 | 13/9 | 42/20 | 449 | 47.5 |
| V2967 | 186.5/189.5 | 228/228 | 13.5/8 | 42.5/18 | 444 | 47 |
| V2968 | 196.5/198 | 239.5/239 | 10.5/6 | 32/10 | 460 | 48 |
| V2969* | 190/193 | 230/233 | 12/9 | 37/18 | 456 | 48 |
| V2970* | 173/173 | 219.5/219.5 | 13.5/10.5 | 44/25 | 443 | 47 |
| V2971 | 157/157.5 | 194/193.5 | 17.5/15.5 | 59/45 | 399 | 43 |
| V2972* | 185/177.5 | 224.5/214.5 | 13.5/10.5 | 49/32 | 423 | 45 |
| V2973* | 159.5/161 | 193.5/193.5 | 16.5/13 | 57/46 | 396 | 42.5 |
| V2974* | 168/172 | 213/215 | 15.5/13 | 57/39 | 422 | 45 |

*steels of the invention

Heat V2969 of the invention shows that excellent yield strength and tensile strength at room temperature are obtainable. The elongation and reduction in area at room temperature are excellent with the use of the lower carbon. Steels with carbon below 0.45% can produce comparable hardness with the steels having at least 0.5% carbon as seen with the results for steels V2969 and V2970.

TABLE 4

ROLL SHELL MECHANICAL PROPERTIES - TOUGHNESS

| HEAT | CVN/32F ft-lbs L/T | CVN/RT ft-lbs L/T | CVN/140F ft-lbs L/T |
|---|---|---|---|
| V2966 | 9/14 | 17.5/13.5 | 20.5/15 |
| V2967 | 12/14.5 | 17.5/11.5 | 21/13 |
| V2968 | 7.5/5 | 10/5.5 | 11/6 |
| V2969* | 9.5/7.5 | 10.5/7 | 14/7.5 |
| V2970* | 14.5/8.5 | 18/12 | 23/13.5 |
| V2971 | 26.5/20.5 | 41/27.5 | 49.5/33 |

TABLE 4-continued

| ROLL SHELL MECHANICAL PROPERTIES - TOUGHNESS | | | |
|---|---|---|---|
| HEAT | CVN/32F ft-lbs L/T | CVN/RT ft-lbs L/T | CVN/140F ft-lbs L/T |
| V2972* | 6.5/7 | 8/9 | 16/10.5 |
| V2973* | 6.5/5.5 | 7.5/7.5 | 14/13 |
| V2974* | 17.5/13.5 | 23/18 | 37.5/25.5 |

*Steels of the invention

It can be seen from TABLE 4 that the lower carbon, controlled molybdenum and vanadium, and higher chromium contents are generally beneficial for improving toughness at all 3 test temperature levels. Since the roll shell application requires properties other than toughness, the alloy is designed for a combination of properties. Steel V2974 has the best toughness for the steels of the invention. Increasing the chromium to 3% in steels V2970, V2971 and V2974 made a dramatic improvement in toughness. Increasing the amount of molybdenum resulted in lower levels of toughness with the steels evaluated.

The results from the above studies illustrate that a unique combination of properties are obtainable for applications such as the roll shell for casting aluminum sheets with the chemistry balance of the present invention. The reduction of heat checking and cracking is a result of providing excellent elevated temperature yield strength. The steels of the present invention can tolerate higher shrink-fit and hoop stresses without brittle failure because of the excellent room temperature toughness and ductility. The roll shells may also benefit by roll coatings, such as Cr plating, which help to retain or improve the properties of the roll shell. U.S. Pat. No. 5,265,332 teaches the manufacture of shells which have been electroplated to prevent galling between the outside diameter of the core and the inside diameter of the shell due to slippage. A typical chromium thickness of 0.001 to 0.01 inches is applied to improve the shrink-fitting.

It is therefore believed to be demonstrated that the ferritic steel alloy of the present invention provides a product which may be forged and heat treated in a conventional manner to produce a cylindrical roll caster shell having excellent resistance to heat checking and cracking at higher shrink-fit stresses which results in excellent service life.

It is to be understood that the chemistry of the invention may include one or more of the preferred or more preferred ranges for an element with any one or more of the broad ranges for the other elements and any combinations of broad and preferred ranges for the elements may be used.

Modifications may be made in the invention without departing from the spirit and scope thereof, and it will be understood that all matter described herein is to be interpreted as illustrative and not as a limitation.

We claim:

1. A roll caster shell having excellent resistance to heat checking at high shrink-fit stresses consisting essentially of, in weight %, 0.25–0.45% C, 1.75–3.7% Cr, 0.7–2.5% Mo, 0.35–0.8% V, 0.3–1% Mn, greater than 0.4–1% Ni, 0.02% max P, 0.02% max S, up to 0.25% Si and balance essentially Fe.

2. The roll caster shell claimed in claim 1, wherein said shell consists essentially of 0.3–0.75% Mn, and greater than 0.4–0.75% Ni.

3. The roll caster shell claimed in claim 1, wherein said shell consists essentially of 0.25–0.35% C, 2.5–3.5% Cr, 1.3–1.8% Mo, 0.45–0.7% V, 0.4–0.6% Mn, and 0.45–0.65% Ni.

4. A steel roll having a shrink-fit shell consisting essentially of in weight %, 0.25–0.45% C, 1.75–3.75% Cr, 0.75–2.5% Mo, 0.35–0.8% V, 0.3–1% Mn, greater than 0.4–1% Ni, 0.02% max P, 0.02% max S, up to 0.35% Si and balance essentially Fe.

5. The roll claimed in claim 4, wherein said shell consists essentially of 0.35–0.75% Mn, and greater than 0.4–0.75% Ni.

6. The roll claimed in claim 4, wherein said shell consists essentially of 0.25–0.35% C, 2.5–3.5% Cr, 1.3–1.8% Mo, 0.45–0.7% V, 0.4–0.6% Mn, and 0.45–0.65% Ni.

7. The roll claimed in claim 4, wherein said shell consists essentially of about 0.3% carbon, about 3% chromium, about 1.5% molybdenum, about 0.5% vanadium, about 0.5% manganese, about 0.5% nickel and balance essentially iron.

8. The roll claimed in claim 4, wherein said shell has an inner diameter coating of chromium to reduce galling between said shell and core during shrink-fitting.

9. A roll caster shell having excellent resistance to heat checking at high shrink-fit stresses consisting essentially of, in weight %, 0.25–0.45% C, 2.5–3.75% Cr, 0.75–2.5% Mo, 0.35–0.8% V, 0.3–1% Mn, greater than 0.4–1% Ni, 0.02% max P, 0.02% max S, up to 0.35% Si and balance essentially Fe.

* * * * *